US005390575A

United States Patent [19]

Saito

[11] Patent Number: 5,390,575

[45] Date of Patent: Feb. 21, 1995

[54] MULTIPLE TOOL FOR PUNCH PRESS

[75] Inventor: Hiroshi Saito, Odawara, Japan

[73] Assignee: Amada Metrecs Company, Limited, Japan

[21] Appl. No.: 90,544

[22] Filed: Jul. 13, 1993

[30] Foreign Application Priority Data

Jul. 14, 1992 [JP] Japan ..... 4-186646

[51] Int. Cl.[6] ..... B21D 28/12; B26F 1/08

[52] U.S. Cl. ..... 83/140; 83/571

[58] Field of Search ..... 83/522, 571, 133, 140

[56] References Cited

U.S. PATENT DOCUMENTS

| | | | |
|---|---|---|---|
| 3,527,130 | 9/1970 | Knehans | 83/454 |
| 4,250,785 | 2/1981 | Morishita et al. | 83/552 |
| 4,555,966 | 12/1985 | Klingel | 83/221 |
| 4,569,267 | 2/1986 | Klingel | 83/552 |
| 4,929,276 | 5/1990 | Chun et al. | 83/552 |
| 4,976,180 | 12/1990 | Otto | 83/133 |
| 4,998,958 | 3/1991 | Chun et al. | 83/552 |
| 5,012,712 | 5/1991 | Nordquist | 83/571 |
| 5,048,385 | 9/1991 | Eckert et al. | 83/571 |
| 5,062,337 | 11/1991 | Johnson et al. | 83/522 |
| 5,072,620 | 12/1991 | Hill et al. | 83/571 |

FOREIGN PATENT DOCUMENTS

| | | |
|---|---|---|
| 131267 | of 1902 | Germany . |
| 63-34754 | 4/1985 | Japan . |
| 1-23627 | 8/1985 | Japan . |
| 2-303636 | 12/1990 | Japan . |
| WO8809232 | 12/1988 | WIPO . |

*Primary Examiner*—Hien H. Phan

*Attorney, Agent, or Firm*—Wigman, Cohen, Leitner & Myers

[57] ABSTRACT

In a multiple tool for a punch press, a plurality of punches (57) are arranged circularly so as to be movable up and down within a stripper guide (41) provided also movably up and down in an upper die holding member (15) of the punch press; a punch driver (77) is disposed so as to be rotatable and movable up and down in a central hole (75) within the stripper guide (41); and a projecting portion (97) is formed in the punch driver (77), for striking any one of a plurality of the punches. Further, an indexing device is mounted to rotate the punch driver (77) so that the projecting portion (97) can be indexed over any required punch (57A), for instance. Since only one required punch of a plurality of the punches can be struck without moving the striker, the multiple tool is simple in structure, high in precision, and low in cost.

9 Claims, 4 Drawing Sheets

MULTIPLE TOOL FOR PUNCH PRESS

BACKGROUND OF THE INVENTION

1. Field of the Invention

The present invention relates to a multiple tool for a punch press, and more specifically to a multiple tool for a punch press, in which a number of tools are arranged circularly in such a way that any one of them can be struck by a striker.

2. Description of the Prior Art

An example of prior art multiple tool to be mounted on a turret punch press is disclosed in Japanese Published Unexamined (Kokal) Patent Application No. 2-303636. However, the prior art multiple tool is of such a duplex structure that there are provided a stripper guide linked with an indexing device so as to be rotatable and movable up and down, and a punch carrier fitted to the stripper guide also so as to be movable up and down. Further, in this prior art multiple tool, punches (not used for a punching) of a plurality of punches of the multiple tool are moved up and down whenever the punch carrier is moved up and down.

In other words, in the prior art multiple tool, since the structure is of duplex type of the stripper guide and the punch carrier, there exists a problem in that the multiple tool is complicated in structure, low in precision, and high in cost. In addition, since the punches not used for a punching are moved up and down, another problem arises in that a rather complicated mechanism is needed to precisely position the punches.

SUMMARY OF THE INVENTION

With these problem in mind, therefore, it is the primary object of the present invention to provide a multiple tool for a punch press, simple in structure, high in precision, easy to locate the punch, and low in cost.

To achieve the above-mentioned object, the present invention provides a multiple tool for a punch press wherein: a plurality of punches (57) are arranged circularly so as to be movable up and down within a stripper guide (41) provided also movably up and down in an upper tool holding member (15) of the punch press; a punch driver (77) is disposed so as to be rotatable and movable up and down within the stripper guide (41); and a projecting portion (97) is formed in said punch driver (77), for striking one of a plurality of said punches.

Further, a stripping block (85) is provided in a lower end of said punch driver (77); and the stripping block (85) is formed with a plurality of catch holes (91) arranged circularly each so as to be slidable along an intermediate diameter portion (63) formed in a lower portion of each of a plurality of the punches.

In the multiple tool according to the present invention, a workpiece is located over a die to be mated with any required punch of the multiple tool, and the punch driver is rotated to index the projecting portion to over the required punch. Then, when the punch driver is struck by a striker, the stripper guide is first moved downward to sandwich the workpiece between the stripper guide and the die. When the punch driver is further moved downward, since the projecting portion strikes the punch located under the projecting portion, the lower end of the punch is projected into the die to punch the workpiece. In this case, the other remaining punches are housed still within the stripper guide and therefore the lower ends of the other remaining punches will not project toward the die and the workpiece.

On the other hand, after punching processing, the striker is moved upward. Then, the punch driver is moved upward by the restoration force of the stripping elastic member, so that the stripping block is also moved upward. During this upward movement of the stripping block, it is possible to securely move the punch upward, because the catch hole formed in the stripping block catches the shoulder portion formed at the upper end of the intermediate diameter portion of the punch. When the striker is moved upward, since the stripper guide is also moved upward away from the workpiece by the restoration force of the return spring, it is possible to move the workpiece away from the position under the striker and to locate another workpiece for the succeeding punching processing.

DETAILED DESCRIPTION OF THE PREFERRED EMBODIMENTS

One embodiment of the multiple tool according to the present invention will be described hereinbelow with reference to the attached drawings.

Figure 5:
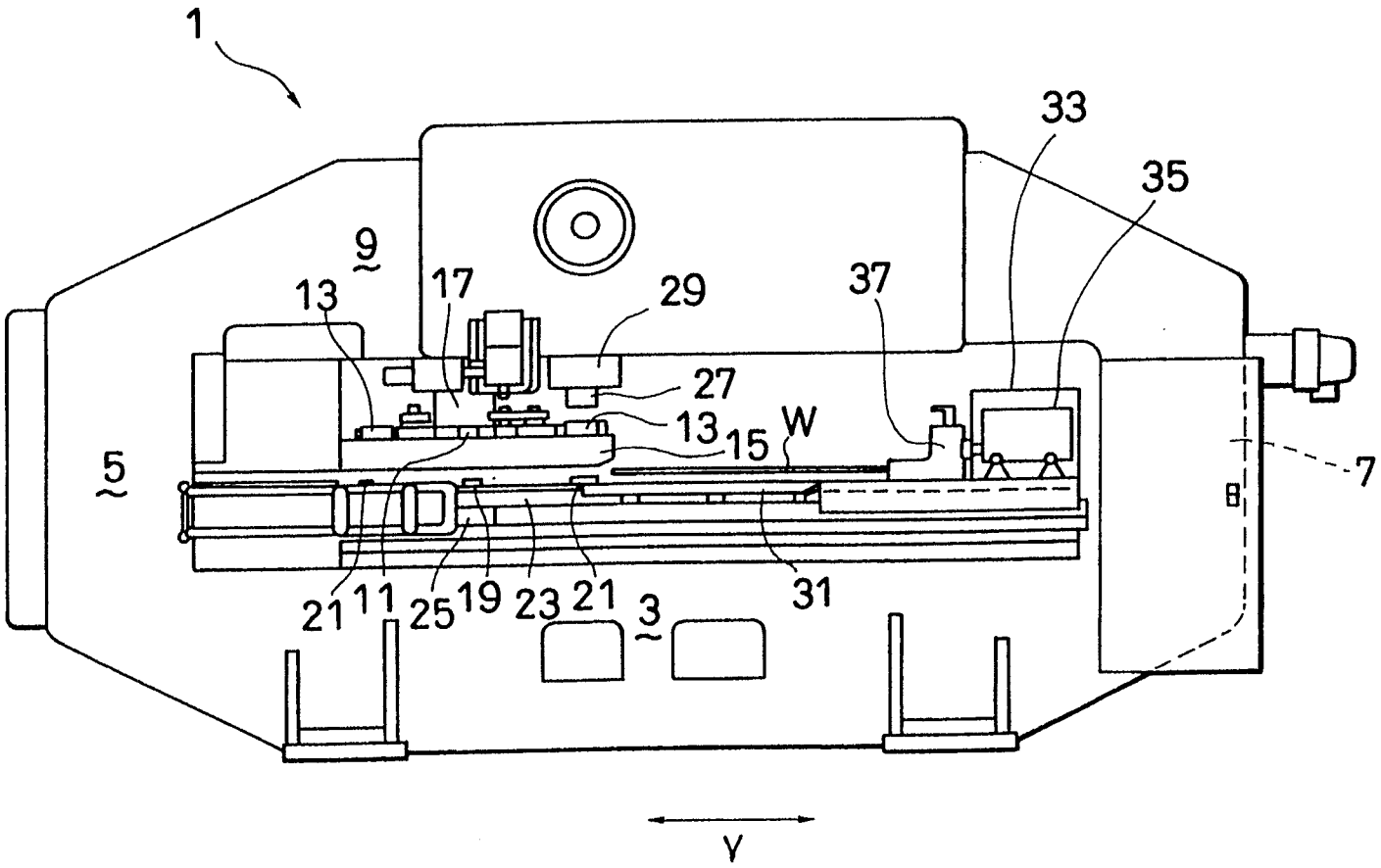
FIG. 5 is a front view showing an overall turret punch press as an example of the punch press on which the multiple tool is to be mounted.

FIG. 5 shows a turret punch press 1 as an example of the punch press. This turret punch press 1 is composed of a base 3, two column frames 5 and 7 provided vertically on both sides of the base 3, and an upper frame 9 provided on the upper side of the column frames 5 and 7.

Further, a disk-shaped upper turret (upper tool holding member) 15 is provided on the lower side of the upper frame 9 so as to be rotatable around an upper rotary axle 17. In the same way, a lower disk-shaped turret (lower tool holding member) 23 is provided on the upper side of the base 3 so as to be rotatable around a lower rotary axle 25 in oppositional positional relationship with respect to the upper turret 15. A single punch 11 and a punch package (upper multiple tool) 13 including a plurality of punches arranged circularly according to the present invention are removably attached to the upper turret 15. A single die 19 and a die package (lower multiple tool) 21 including a plurality of dies arranged circularly are removably attached to the lower turret 23. The upper single punch 11 and the lower single die 19 form a pair of tools. The plurality of punches of the upper punch package 13 and the plurality of dies of the lower die package 21 are also form a plurality of pairs of tools. Further, a column 29 having a striker 27 is provided on the lower side of the upper frame 9 so as to be movable up and down, to strike the single punch 11 and the punch package 13.

The upper turret 15 and the lower turret 23 are both controllably rotated by a turret servomotor (not shown)

mounted on the frame, so that a pair of any required single punch 11 and single die 19 or a pair of any required punch package 13 and die package 21 can be selectively located at the punching position under the striker 27.

Further, a fixed table (not shown) is provided at the middle upper portion of the base 3. A pair of movable tables 31 are movably supported on both sides of this fixed table so as to be controllably moved in the Y-axis direction (in the right and left direction in FIG. 5). Further, a carriage base 33 is fixed to the movable table 31 in such a way as to cross the fixed table. Further, the carriage base 33 is provided with a carriage 35 movable in the X-axis direction (the direction perpendicular to the sheet of the drawing of FIG. 5). Further, the carriage 34 is provided with a work clamp 37 for clamping one end of a plate-shaped workpiece W.

Therefore, the workpiece W can be located between the upper turret 15 and the lower turret 23, by controllably moving the movable table 31 in the Y-axis direction and further by controllably moving the carriage 35 in the X-axis direction on the carriage base 33.

The workpiece W located as described above can be punched by a pair of any required single punch 11 and single die 19, or by a pair of any required punch package 13 and die package 21 which are selectively located by rotating the upper turret 15 and the lower turret 23.

Figure 1:
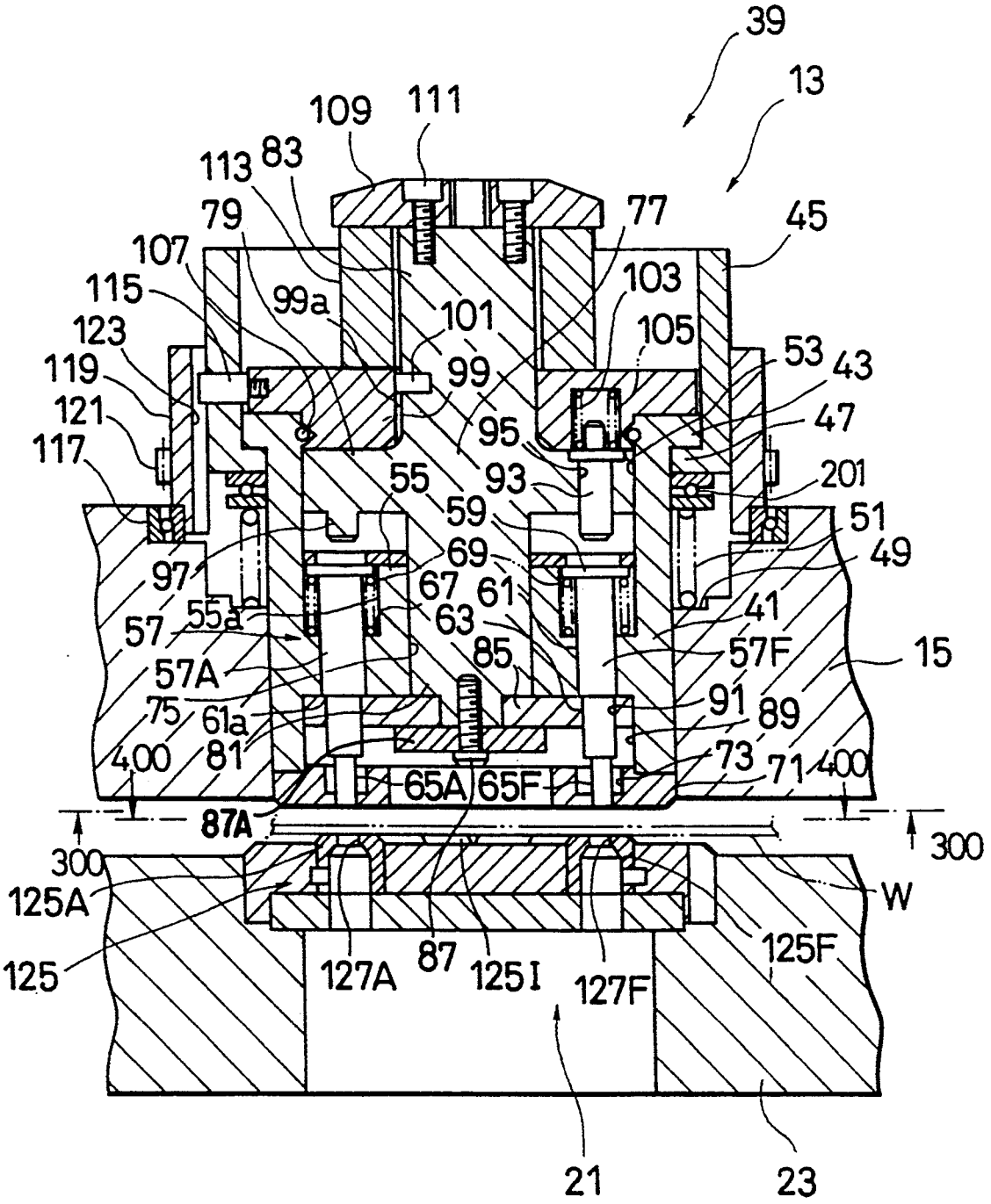
FIG. 1 is a cross-sectional view showing a multiple tool for a punch press according to the present invention, in which no load is applied.

With reference to FIG. 1, the multiple tool 39 for the punch press according to the present invention will be described in detail hereinbelow. The multiple tool 39 is composed of the punch package 13 and the die package 21, as already described. The punch package 13 is provided with a cylindrical stripper guide 41 supported by the upper turret 15 so as to be movable up and down. Although not shown in the drawing, the stripper guide 41 is provided with, for example, a key engaged with a vertical key way formed in the upper turret 15. Thus, the stripper guide 41 is prevented from rotating relative to the upper turret 15. A lower flange portion 47 of a cylindrical rotary tube 45 is fitted to an upper flange portion 43 of the stripper guide 41. A guide spring 51 is disposed via a thrust bearing 201 between the lower surface of the flange portion 47 of the rotary tube 45 and the bottom surface 49 of a stepped bore formed in the upper surface of the upper turret 15, so that the stripper guide 41 is urged upward by this guide spring 51.

Figure 3:
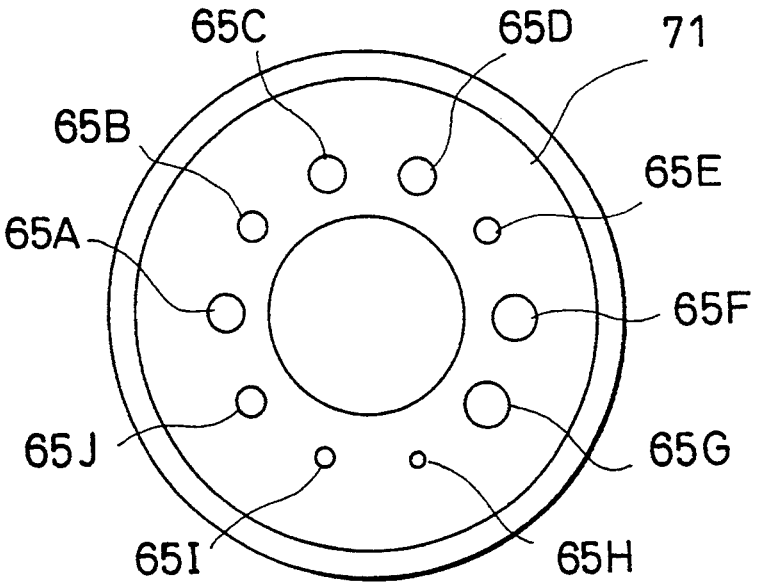
FIG. 3 is a bottom view taken along the lines 300—300 in FIG. 1.

The stripper guide 41 is formed with an inner flange 55 for partitioning an upper inner bore 53 opening upward and a lower inner bore 89 opening downward. A plurality of punches 57 are circularly arranged along the inner circumferential surface of the inner flange 55 so as to be movable up and down. These punches 57 are designated as 57A, 57B, . . . , 57J, because the end shapes thereof are all different from each other, respectively. Each of these punches 57A, 57B, . . . , 57J is formed with a head portion 59, a large-diameter portion 61 serving as a guide portion, and an intermediate diameter portion 63, and a small-diameter punching portion 65A, 65B, . . . , 65J, respectively, in order from the upper side to the lower side. The cross section of each of these punch portions 65A, 65B, . . . , 65J is different from each other in diameter size as shown in FIG. 3 or even in cross section (e.g., square, hexagonal, etc.). Therefore, it is possible to punch holes of different dimensions or shapes in a workpiece W by appropriately selecting one of the punches 57A, 57B, . . . , 57J. Further, a hold spring 69 is disposed between the lower surface of the head portion 59 of the punch 57 and the upper surface of the inner flange 55 (the bottom surface 67 of the upper inner bore 55a) to urge the respective punches 57A, 57B, . . . , 57J upward. Further, a stripper plate 71 is disposed at the lower end of the stripper guide 41 to guide the punch portion 65A, 65B, . . . , 65J by a plurality of stepped holes 73 arranged also circularly.

A central hole 75 is formed at the center of the inner flange 55 of the stripper guide 41 to guide a punch driver 77 so as to be movable up and down. The punch driver is rotatable relative to the stripper guide 41 (as will be described in detail hereinafter). The punch driver 77 is formed with a middle flange portion 79, a lower shaft portion 81 guided by the central hole 75, and an upper shaft portion 83. Further, a stripping block 85 is rotatably provided on the lower end of the lower shaft 81 with a bolt 87 and a support plate 87A; the stripping block 85 is rotatable about a longitudinal axis of the punch driver 77. This stripping block 85 is fitted to the lower inner hole 89 of the stripper guide 41 so as to be movable up and down (together with the punch driver 77) relative to the stripper guide 41. The stripping block 85 is formed with a plurality of catch holes 91 engaged with the intermediate diameter portions 63 of the punches 57, respectively.

Further, the intermediate flange portion 79 of the punch driver 77 is formed with a plurality of guide holes 95 arranged circularly along the same circle and at the same pitch of the punches 57. A plurality of backup pins 93 are fitted into these guide holes 95, respectively so as to be movable up and down. However, a downward projecting (strike-down) portion 97 is formed in the intermediate flange portion 79 at only one position, instead of the guide hole 95 and the backup pin 93, as shown on the left side in FIG. 1. By rotating the punch driver 77 relative to the stripper guide 41, the projecting or strike-down portion 97 can be indexed (rotated for angular location) to over any one of a plurality of punches 51, for instance to over the punch 57A to strike down only this selected punch 57A.

An annular shaped rotary plate 99 fixed to the rotary tube 45 by a pin 115 is engaged with the upper shaft portion 83 of the punch driver 77 by a key 101 (fixed to the punch driver 77) and a key way 99a (formed in the plate 99). Thus, the punch driver 77 is movable in the vertical direction, and is rotatable together with the rotary tube 45. The rotary plate 99 is formed with a plurality of downward opening bores 103 at such positions as to face the backup pins 93, respectively. A backup spring 105 is disposed in each of these inner bores 103 to urge the backup pin 93 downward. With the backup pin 93 and the backup spring 105, the possible vibrations of the punches 57 not used during a punching can be suppressed and further the punches 57 are allowed to move upward for relief where necessary, as described in detail hereinafter.

The rotary plate 99 and the upper portion of the stripper guide 41 are engaged with each other via a ring 107 so as to be rotatable but not to be movable up and down relative to each other. A head plate 109 is fixed to the upper end surface of the upper shaft 83 with a plurality of bolts 111. A stripping elastic member 113 formed of an elastic material such as urethane rubber, for instance is interposed between the lower surface of the head plate 109 and the upper surface of the rotary plate 99.

A gear tube 119 is rotatably supported by a bearing 117 on the upper side of the upper turret 15 so as to enclose the outer circumferential surface of the rotary tube 45. This gear tube 119 is formed with a gear 121 on the outer circumferential surface thereof and with a key groove 123 on the inner circumferential surface thereof. A head portion of the pin 115 of the rotary tube 45 is engaged with this key groove 123. A well-known gear of an indexing device (as disclosed in Japanese Published Unexamined (Kokal) Patent Application No. 1-52096, for instance) is geared with this gear 121.

Figure 4:
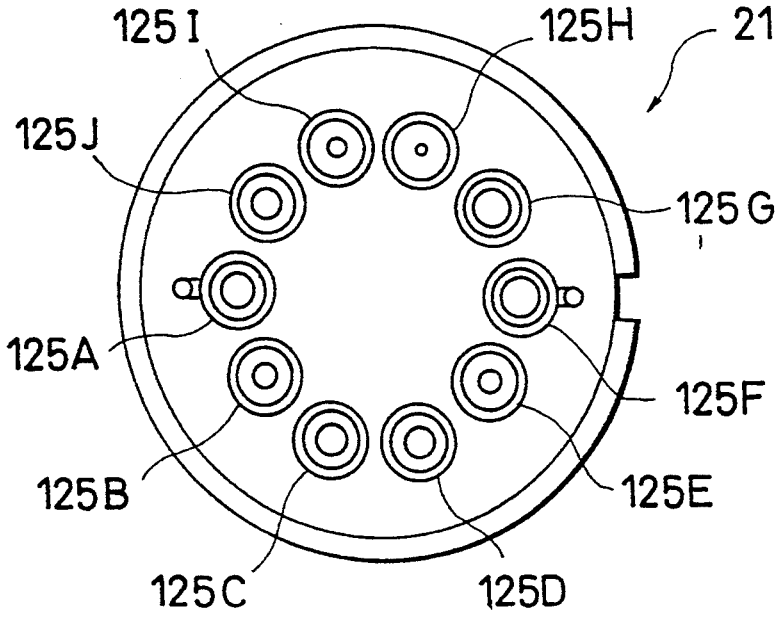
FIG. 4 is a top view taken along the lines 400—400 in FIG. 1.

On the other hand, on the lower turret 23, a die package 21 is disposed in oppositional positional relationship with respect to the punch package 13. A plurality of dies 125 are arranged on the die package 21. In more detail, a plurality of dies 125A, 125B . . . , 125J are arranged so as to face the punches 57A, 57B, . . . , 57J, as shown in FIG. 4. The dies 125A, 125B, . . . , 125J are formed with die holes 127A, 127B, . . . , 127J, respectively so as to be fitted to the cross sectional shapes of the to-be-mated punching portions 65A, 65B, . . . , 65J of the punches 57, respectively. In this embodiment, the construction of a plurality of the dies 125 is simple as the dies 125 are neither rotated nor moved up and down.

Figure 2:
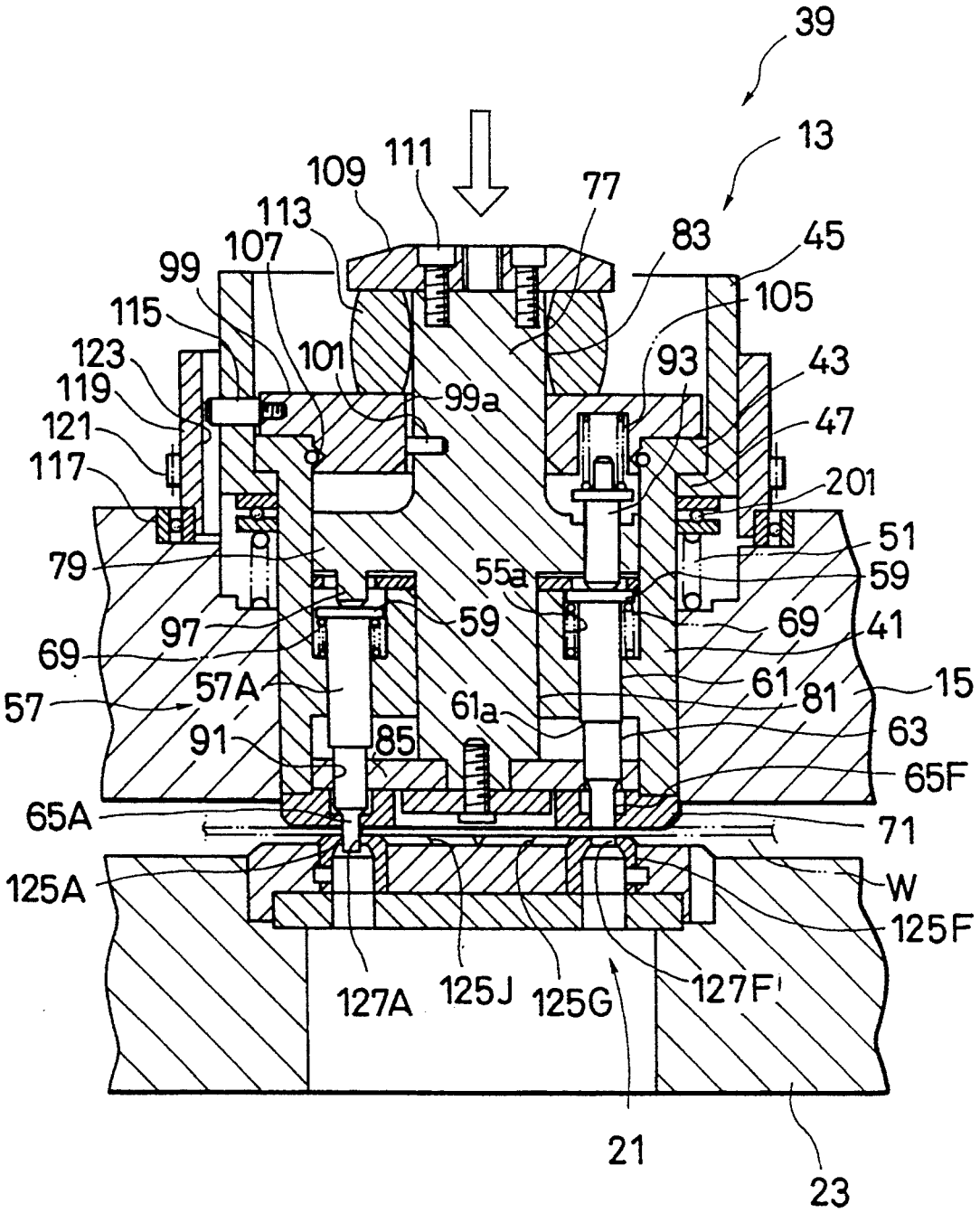
FIG. 2 is an cross-sectional view showing the multiple tool for a punch press according to the present invention, in which a load is applied.

The operation of the multiple tool 39 for the punch press according to the present invention will be described hereinbelow with reference to further FIGS. 1 and 2.

First, the upper and lower turrets 15 and 23 are rotated to index any required punch package 13 and the die package 21 to under the striker 27. Further, the carriage base 33 and the carriage 35 are moved to locate the workpiece W to above the required die 125A, for instance. When the indexing device is actuated, the gear tube 119 is rotated, so that the rotative power thereof is transmitted from the rotary tube 45 to the rotary plate 99 and further to the punch driver 77. Therefore, it is possible to index the projecting portion 97 (the striking portion) of the intermediate flange portion 79 of the punch driver 77 to over any required punch 57A, for instance.

After the projecting portion 97 has been indexed, the ram 29 is actuated to move down the striker 27 for striking the head plate 109. Then, the punch driver 77 is moved downward. Under these conditions, the rotary plate 99, the stripper guide 41, and the rotary tube 45 moved down together against the urging force of the guide spring 51, without compressing the stripping elastic member 113. Thus, the stripper plate 71 is brought into contact with the workpiece W, and the workpiece W is sandwiched between the die 125 and the stripper guide 41. Thereafter, when the striker 27 is further moved downward, the punch driver 77 is further moved downward by compressing the stripping elastic member 113.

Under these conditions, the projecting portion 97 strikes the head portion 59 of the punch 57A. Thus, the punch 57A is moved downward by compressing the hold spring 69, so that the punching portion 65A of the punch 57A projects from the lower surface of the stripper plate 71 to punch out the workpiece W and further into the die hole 127A of the die 125A, thus punching processing being completed as shown in FIG. 2.

Here, when the punch driver 77 is moved downward, since the backup pins 93 urged by the backup springs 105, respectively, are brought into contact with the head portions 59 of the other remaining punches 57B . . . , 57J not used, these punches 57B, . . . , 57J are not jumped upward due to a shock of the punching processing. Further, the elastic force of the hold spring 69 is selected to be stronger than that of the backup spring 105; thus, the other remaining punches 57B, . . . , 57J not used are not projected downward out of the stripper plate 71.

Successively, when the ram 29 is actuated to move the striker 27 upward, the punch driver 77 is first moved upward by a restoration force of the stripping elastic member 113. Then, the punch 57A whose punching portion 65A is inserted into the die hole 127A is moved upward to the position flush with the other remaining punches 57B, . . . , 57J, because the shoulder portion 61a formed between the large diameter portion 61 and the intermediate portion 63 of the punch 57A is caught by the catch hole 91 formed in the stripping block 85.

When the striker 27 and the punch driver 77 are further moved upward, the stripper guide 41, the rotary tube 45 and the rotary plate 99 all move upward by the restoration force of the guide spring 51, so that the stripper plate 71 is also moved away from the workpiece W.

Thereafter, when the striker 27 is further moved upward to an upper dead point, the striker 27 is moved away from the head plate 109. Then, the upper surface of the intermediate flange portion 79 of the punch driver 77 is brought into contact with the lower surface of the rotary plate 99 by the restoration force of the stripping elastic member 113, so that the upward movement of the punch driver 77 stops. Under these conditions, the lower end of tile projecting portion 97 of the punch driver 77 is away from the head portion 59 of the punch 57. In addition, since the head portion of the backup pin 93 is brought into contact with the upper surface of the intermediate flange portion 79 of the punch driver 77, the lower end of the backup pin 93 is also brought away from the head 59 of the punch 57. Therefore, it is possible to rotate the punch driver 77 to further index the projecting portion 97 to above any required one of the punches 57A, 57B, . . . , 57J, without any interference.

As described above, in the multiple tool according to the present invention, since a plurality of punches 57 are housed in the punch package (upper multiple tool) 13 and further arranged circularly within the stripper guide 41 fitted in the upper turret (upper die holding member) 15 so as to be movable up and down, the multiple tool is simple in structure and easy to secure the processing precision, thus improving the punching quality. Further, since the structure is simple, the manufacturing cost can be reduced.

In addition, since the punching processing can be made by indexing only the projecting portion 97 of the punch driver 77 to any required punch (e.g., 57A) by use of the indexing device, to strike only the required punch, without moving the other remaining punches up and down within the stripper guide 41, it is possible to locate the workpiece W accurately at only the required punch position accurately, irrespective of the positions of the other remaining punches, thus improving the working efficiency of the punching processing.

Further, since the punching processing can be made by indexing the projecting portion 97 of the punch driver 77 to any required punch (e.g., 57A), by use of the indexing device, without moving the striker and the die package 21, the structure is further simplified for further reduction of manufacturing cost.

What is claimed is:

1. A multiple tool for a punch press, the punch press including an upper tool holding member, comprising:

a stripper guide mounted movably up and down on the upper tool holding member;

means for preventing the stripper guide from rotating relative to the upper tool holding member;

a plurality of punches arranged circularly on the stripper guide so as to be movable up and down, each punch being provided with a head section which is movable up and down in an upper inner bore formed in the stripper guide;

a punch driver disposed so as to be rotatable and movable up and down within the stripper guide; and a projecting portion formed on said punch driver, for striking any one of a plurality of said punches, wherein the upper inner bore receives said projecting portion of said punch driver.

2. The multiple tool for a punch press of claim 1, wherein each of the plurality of punches includes a shoulder portion and an intermediate diameter portion, and the punch driver carries a stripping block at a lower end thereof, said stripping block being formed with a plurality of catch holes arranged circularly each so as to be slidable up and down along the intermediate diameter portion and engageable with the shoulder portion.

3. The multiple tool for a punch press of claim 1, further comprising a rotary tube engaged with the stripper guide in the vertical direction in such a way that the rotary tube and the stripper guide are movable together in the vertical direction, and the rotary tube is rotatable relative to the stripper guide.

4. The multiple tool for a punch press of claim 3, further comprising a rotary plate mounted on the rotary tube, and a backup pin circularly mounted on the lower surface of the rotary plate in such a way as to be movable up and down.

5. The multiple tool of claim 3, further comprising a rotary plate mounted on the rotary tube, and means for engaging the rotary plate with the punch driver in such a way that the punch driver is movable in the vertical direction and is prevented from rotation relative to the rotary tube.

6. The multiple tool for a punch press of claim 5, further comprising a gear tube having a gear section and adapted to rotate the rotary tube.

7. The multiple tool of claim 5, wherein the means for engaging the rotary plate with the punch driver includes a key provided in the punch driver and a key way provided in the rotary plate.

8. The multiple tool of claim 1, wherein the means for preventing the stripper guide from rotating relative to the upper tool holding member includes a key provided on the stripper guide, and a key way provided in the upper tool holding member.

9. A multiple tool for a punch press, the punch press including an upper tool holding member, comprising:

a stripper guide mounted movably up and down on the upper tool holding member;

a plurality of punches arranged circularly on the stripper guide so as to be movable up and down, each punch being provided a head section which is movable up and down in an upper inner bore formed in the stripper guide;

a punch driver disposed so as to be rotatable and movable up and down within the stripper guide; and a downwardly projecting portion rigidly formed on said punch driver, for striking any one of a plurality of said punches, wherein the upper inner bore receives the projecting portion of the punch driver;

a rotary tube engaged with the stripper guide in the vertical direction such that the rotary tube and the stripper guide are movable together in the vertical direction, and the rotary tube is rotatable relative to the stripper guide;

a rotary plate mounted on the rotary tube;

a plurality of backup pins circularly mounted on the lower surface of the rotary plate so as to be movable up and down, said backup pins having a number one less than the number of punches, said backup pins and said downwardly projecting portion each shaped similarly so as to engage a single punch; and a gear tube having a gear section and adapted to rotate the rotary tube.

* * * * *